US005105889A

United States Patent [19]

Misikov et al.

[11] Patent Number: 5,105,889

[45] Date of Patent: Apr. 21, 1992

[54] METHOD OF PRODUCTION OF FORMATION FLUID AND DEVICE FOR EFFECTING THEREOF

[76] Inventors: Taimuraz K. Misikov, ulitsa R. Juxemburg, 9, kv. 4; Vladimir M. Shaposhnikov, ulitsa 50 let VLKSM, 40/3, kv. 59, both of Stavropol; Alexandr P. Skripkin, Mikroraion 8, 33a, kv. 77, Budennovsk Stavropolskogo kraya, all of U.S.S.R.

[21] Appl. No.: 619,419

[22] Filed: Nov. 29, 1990

[51] Int. Cl.[5] ..... E21B 43/00

[52] U.S. Cl. ..... 166/372

[58] Field of Search ..... 166/372, 105, 162, 106, 166/163, 169, 242

[56] References Cited

U.S. PATENT DOCUMENTS

| | | | |
|---|---|---|---|
| 3,720,113 | 3/1973 | van Doorne et al. | 474/201 |
| 3,974,878 | 8/1976 | Roeder et al. | 166/372 |
| 4,410,041 | 10/1983 | Davies et al. | 166/372 X |
| 4,433,965 | 2/1984 | Hattori et al. | 474/201 |
| 4,480,697 | 11/1984 | Goldaniga et al. | 166/372 |
| 4,610,648 | 9/1986 | Miranti, Jr. | 474/242 |

FOREIGN PATENT DOCUMENTS

| | | |
|---|---|---|
| 0000802 | 8/1978 | European Pat. Off. . |
| 0014013 | 1/1980 | European Pat. Off. . |
| 0014492 | 1/1980 | European Pat. Off. . |
| 0073962 | 8/1982 | European Pat. Off. . |
| 0242263 | 4/1987 | European Pat. Off. . |
| 0259646 | 8/1987 | European Pat. Off. . |
| 0305227 | 7/1988 | European Pat. Off. . |
| 0325497 | 1/1989 | European Pat. Off. . |
| 2557724 | 12/1975 | Fed. Rep. of Germany . |
| 6056649 | 5/1926 | France . |
| 1066329 | 6/1954 | France . |
| 2089587 | 4/1971 | France . |
| 2437531 | 11/1978 | France . |
| 2527723 | 6/1982 | France . |
| 2536486 | 11/1982 | France . |
| 2536487 | 11/1982 | France . |
| 2540953 | 2/1983 | France . |
| 2625783 | 1/1988 | France . |
| 61-127948 | 12/1981 | Japan . |
| 59-131052 | 1/1983 | Japan . |
| 61-206847 | 9/1986 | Japan . |

*Primary Examiner*—Thuy M. Bui

*Attorney, Agent, or Firm*—Beveridge, DeGrandi & Weilacher

[57] ABSTRACT

A method of production of the formation fluid is used in wells with a low formation pressure and consists in that in the well from a flow of the formation fluid forcedly liberated is the gas dissolved therein and then the formation fluid is transformed into a finely dispersed gas-liquid flow in which the amount of liberated gas ensures self-lift of the formation fluid to the wellhead. A device, effecting this method, comprises a body hermetically secured in the well string, a nozzle and Venturi tubes. The Venturi tubes are installed over the nozzle, coaxially with it, and each below-positioned tube serves as a nozzle for the above-positioned one.

23 Claims, 3 Drawing Sheets

METHOD OF PRODUCTION OF FORMATION FLUID AND DEVICE FOR EFFECTING THEREOF

TECHNICAL FIELD

The present invention refers to the oil-and-gas industry, more particularly, relates to a method of producing the formation fluid and a device for effecting thereof which can be used in all existing wells. The present invention can be most successfully used in wells with a low formation pressure, for example, in the production of oil, gas condensate or mineral water, evacuation of formation waters in gas wells, and so on.

CHARACTERISTIC OF THE PREVIOUS ART

Widely known in the art is a natural flowing method of producing the formation fluids—oil or gas condensate, wherein lifting of the formation fluid from the well bottom to the wellhead is effected due to natural energy (pressure of the formation fluid and energy of the gas dissolved therein). In the process of the long-time operation of the well by the natural flowing method, the formation pressure lowers; incidentally, lowering of the formation pressure below the hydrostatic pressure of the formation fluid column results in the well shut-in, inasmuch as in this case the natrual energy of the reservoir is insufficient for lifting the formation fluid to the wellhead. In this case specialists resort to lowering of the hydrostatic (stagnation) pressure or to a gas-lift method of production of the formation fluid.

lowering of the bottom-well pressure below that of saturation of the formation fluid with gas results in degassing of the formation fluid (oil, for example) in the hole-bottom zone of the reservoir, clogging of pore space of the reservoir and, as a consequence, in a decline of productivity of the formation and its oil recovery. To prevent the latter phenomenon, a pressure is built up in the wellhead, for which purpose installed is a choke whose hole diameter is selected proceeding from the condition of building up the necessary bottom-hole pressure owing to limitation of the production rate of the formation fluid. However, the necessity of adjustment of the bottom-hole pressure with a view to prevent its drop below the saturation pressure also leads to stopping the natural flowing and premature transfer of the well to a mechanized production of the formation fluid, i.e. a gas-lift method of produciton (refer to, for example, "Operation of oil and gas wells" by V. M. Muraviov. Moscow, Nedra Publishing House, pp. 147–157).

In compliance with the known method of gas-lift production of the formation fluid, pumped into the tubing at a definite depth selected depending on the compressor power, i.e. pressure which it can build up, through the hole clearance is compressed gas which, getting into the flow of the formation fluid, saturates it and, as the pressure in the well drops, expands, thus making the formation fluid column lighter, facilitating its carrying out to the wellhead and pressure decrease in the hole bottom, owing to which fact the depression (a difference between the fluid pressure in the reservoir and in the well bottom) is increased and the fluid starts lifting from the well bottom to the wellhead.

However, such method of gas-lift production of the formation fluid is characterized by an increased cost of both the fluid produced, and a higher cost of the well operation, since pumping of compressed gas into the hole clearance requires an appropriate power-intensive equipment, equipment control and gas consumption systems, and complicates operation of the well.

THE OBJECT OF BRIEF DESCRIPTION OF ESSENCE OF THE INVENTION

It is an object of the present invention to develop a highly efficient method of produciton of the formation fluid having a lower formation pressure.

It is also an object of the present invention to reduce the production cost of the formation fluid.

Still another object of the invention is to simplify operation of the well.

And finally, one more object of the invention is to raise the efficiency of development of the formation fluid.

Another object of the invention is to develop a device, simple in design and reliable in operation, for realizing the method of production of the formation fluid having a low formation pressure.

The above and other objects of the invention are accomplished by the method of producing the formation fluid from the well, according to which the gas dissolved in the formation fluid is forcedly liberated from the created flow of fluid and the formation fluid is transformed into a finely dispersed gas-liquid flow so that in the well, from the place of transformation to the wellhead, formed is a column of a finely-dispersed gas-liquid flow with such an amount of liberated gas therein, at which the total pressure of this fluid column and the wellhead pressure is below the pressure of saturation of the formation fluid with gas, and below the difference between the bottom hole pressure and the pressure of the formation fluid column from the formation occurrence depth to the place of the above mentioned transformation.

Due to this transformation of the formation fluid in the well, its lift to the wellhead is effected owing to the employment of energy of the gas dissolved in this formation fluid, without additional power expenditure, i.e. a self-lift (or autolift) system is created even in wells with a low formation pressure. This makes it possible to raise the efficiency of development of formation fluids, to lower the production cost of the formation fluids, and also, to lower operation costs.

To prevent a dispersion-circular mode of flowing of the gas-liquid stream, its wellhead pressure is set not below the critical pressure of separation of this stream into independent phases.

In compliance with the method, the bottom-hole pressure of the formation fluid is set and maintained at a higher level than that of the pressure of saturating it with gas, which prevents degassing of the formation fluid in the hole-bottom zone and eliminates lowering of the formation productivity factor.

To raise the efficiency of evacuation of the formation fluid in which the amount of dissolved gas is insufficient for creating the conditions for selflifting the formation fluid, it is necessary to form a zone of relative rarefaction by means of a gas-liquid of a gas-liquid flow, and to saturate the gas-liquid flow with an additional amount of gas supplied from the wellhead owing to a difference between the wellhead pressure and that in the zone of relative rarefaction and being dependent on the degree of saturation of the formation fluid, the additional amount of gas being obtained by way of separation of said gas-liquid flow in the wellhead, while the wellhead pressure being built up by means of the pressure developed during separation.

In compliance with the method, introduced into the gas-liquid flow simultaneously with saturating it with an additional amount of gas is a prescribed amount of appropriate chemical substances depending on the conditions of well operation. This makes it possible to fully eliminate operation, power and raw materials expenditures for self-lifting of the formation fluid due to the gas liberated from the formation fluid and to use it in the closed cycle circuit for raising the efficiency of development of the formation fluid, as well as for bringing into the well chemical substances in order to fight corrosion, salt-wax accumulations, and so on.

In compliance with the method, the place of transformation of the formation fluid is located at a depth exceeding that of the formation occurrence, which fact renders it possible to raise the bottom-hole pressure by way of increasing the weight of the formation fluid column, owing to the employment of an artificial bottom which is arranged below the depth of formation occurrence.

The device for effecting the claimed method of producing the formation fluid comprises a body, hermetically secured in the string, a nozzle installed in the body along the axis of the well, and Venturi tubes installed in the body over the nozzle and aligned with the latter for forced liberation of gas dissolved in the formation fluid and transformation of a high-speed stream, flowing out of the nozzle, into a finely dispersed gas-liquid flow, the Venturi tubes being arranged one over the other so that each tube arranged below the other serves as a nozzle for that arranged above.

In the device body it is expedient to make a receiving chamber arranged over the upper Venturi tube and in alignment with it, a mixing chamber installed in alignment with the receiving chamber and above it, and a diffuser installed over the mixing chamber and communicated with the latter. In such an alternative embodiment, the device comprises a means hermetically communicating the receiving chamber with the wellhead and which serves for the supply to this receiving chamber of an additional amount of gas owing to a difference between the wellhead pressure and that in the rarefaction zone which is built up in the receiving chamber by the gas-liquid flow.

According to the other alternative embodiment of the device, the device body carries under the nozzle a hydraulic pulser for transforming the laminar flow of the formation fluid into a pulsating one which in the diffuser is transformed into a laminar gas-fluid flow after the forced liberation of gas from it.

As seen from the above description, the claimed method is effected by the means simple in design which can be practically installed in any well without its complication.

BRIEF DESCRIPTION OF DRAWINGS

The invention will be further described in detail with reference to its alternative embodiments and attached drawings in which.

BRIEF DESCRIPTION OF AN ALTERNATIVE EMBODIMENT OF THE INVENTION

Figure 1:
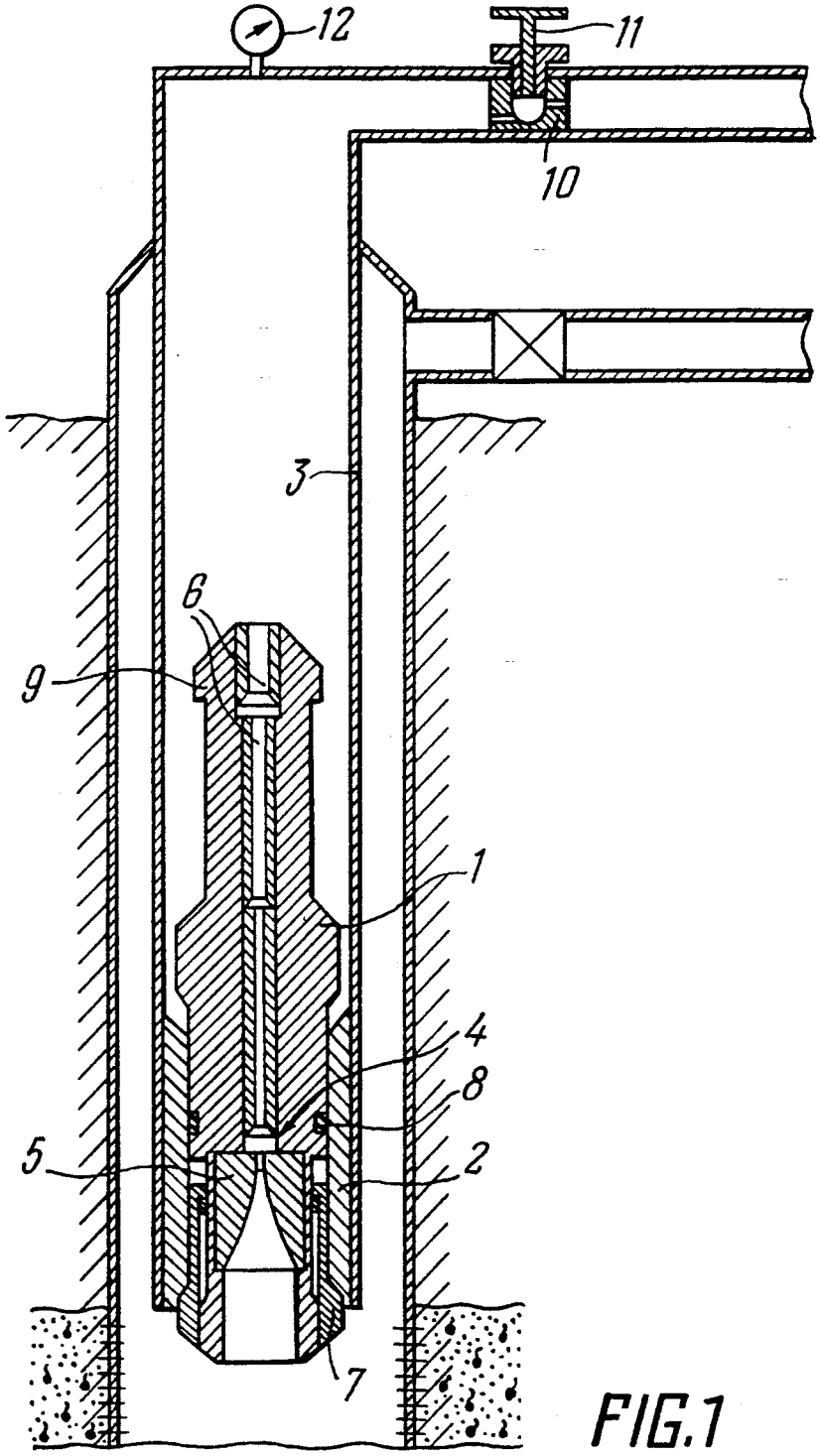
FIG. 1 is a schematic illustration of the general view of the device for the production of the formation fluid, according to the invention, longitudinal section.

The claimed method of producing the formation fluid, for example, oil from the formations with a normal or low formation pressure, i.e. with a formation pressure below 0.8 of the hydrostatic pressure of the formation fluid column in the well, can be used practically in all oil or gas condensate deposits, as well as in wells subjected to conservation due to unprofitableness of their operation, and is effected as follows.

Using the known methods, determined are formation pressures ($P_f$), temperature ($T_f$), fluid density ($\gamma_d$), bottom-hole pressure ($P_{bh}$), saturation of the formation fluid with gas dissolved therein (G) and a free gas, fluid saturation pressure ($P_{sat}$) and production rate of the formation fluid (Q) as a function of the depression ($\Delta P = P_f - P_{bh}$, formation occurrence depth (H), density of the obtained gas-liquid mixture ($\gamma_m$), and the necessary wellhead pressure ($P_{wh}$). Then the well is put in operation by the known methods, i.e. a flow of the formation fluid is created in this well whose lift from the well bottom to the wellhead is effected due to a difference between the formation, well-bottom and wellhead pressures. To maintain the conditions of a flow of the formation fluid, in the well at the prescribed depth, depending on the well and formation conditions and physical properties of the formation fluid, forcedly liberated is the gas dissolved in the formation fluid and the formation fluid flow is transformed into a finely dispersed gas-liquid flow so that in the well, from the place of transformatin to the wellhead, formed is a column of finely dispersed gas-liquid flow with such an amount of liberated gas therein, at which the total pressure of this fluid column and the wellhead pressure is set below the pressure of saturation of the formation fluid with gas and below the pressure difference between the well bottom pressure and that of the formation pressure column, from the depth of its occurrence to the place of transformation.

The depth of the place of transformation of the formation fluid into a finely dispersed gas-liquid flow ($H_s$) is determined, proceeding from the following condition:

$$P_f - \Delta P - \gamma_d(H - H_s) \geqq \gamma_m H_s + P_{wh}$$

from the formula $$H_s \leqq [\gamma_d H + P_{wh} - (P_f - \Delta P]: (\gamma_d - \gamma_m)$$

Forced liberation of the gas dissolved in the formation fluid can be effected by the known method, for example, by way of throttling, raising the temperature or by way of electric-pulse treatment.

Throttling is the most preferable method used for liberation of gas dissolved in the formation fluid, as the technique which most fully employs the energy of the formation fluid flow and requires no great power or material expenditure.

As a result of this, employed for lifting the formation fluid is the potential energy of gas dissolved in the formation fluid which in the process of throttling, being transformed into a kinetic energy, moves the formation fluid in the form of a finely dispersed gas-liquid flow, i.e. a system of self-lifting or "autolift" is thus formed owing to a considerable reduction density of the formation fluid column in the well from the place of its transformation to the wellhead.

In the process of operation of the well, the pressure of the gas-liquid flow in the wellhead is set not below the critical pressure of separation of this flow into independent phases at which the relation of gas volume to that of oil would not exceed a figure of ten, which is accomplished, for example, by way of stalling a controllable valve in the wellhead, whose principle of operation is based on its ability to open or shut down at a pressure rise or drop relative to the prescribed value, the valve flow section also varying depending on the well production rate. This makes it possible to minimize the dispersion-annular mode of motion of the gas-liquid flow in the well, thus raising the efficiency of compressed gas power.

The rise of the wellhead pressure usually results in, other conditions being equal, a rise of bottom-hole pressure; however, in this case it will result in, owing to stabilization and a decrease of the weighted mean density of the gas-liquid flow column, a drop of pressure over the depth of transformation which is necessary and sufficient for oil degassing all along the path of its travel from the well bottom to the wellhead.

A drop of bottom-hole pressure below the pressure of saturation of the formation fluid with gas leads to degassing of oil in the formation, increase of its viscosity, drop of the formation productivity and, as a consequence, to a decline in oil recovery; therefore, in the claimed method, stabilization and maintaining of the bottom-hole pressure are performed at the level that exceeds the saturation pressure, for example, by way of limitation of the production rate through throttling the flow in the well bottom.

In cases when the amount of gas dissolved in the formation fluid is insufficient for the accomplishment of the claimed method, a zone of relative rarefaction is developed in the well by means of the gas-liquid flow which is then saturated with an additional amount of gas supplied from the wellhead owing to a difference between the wellhead pressure and the pressure in the zone of relative rarefaction, said difference depending on the degree of saturation of the formation fluid with gas.

The additional amount of gas for saturation of the gas-liquid flow can be taken from the low-pressure gas distribution network but the most expedient way is to use the gas obtained through the wellhead separation of the gas-liquid flow, oil, for exapmle as a result of which the separated oil is directed to an oil collector, while the gas thus obtained—to the zone of relative rarefaction of the well, the separation pressure being used for building up the wellhead pressure of gas. The separation pressure is regulated by the controllable valve so that gas saturation of oil in the wellhead does not exceed a figure of ten, on the one hand, and on the other hand—that said gas saturation would ensure maximum gas pressure at the stable oil recovery conditions through the use of the claimed method.

Simultaneously with saturation of the gas-liquid flow with an additional amount of gas, a prescribed quantity of respective chemical substances is introduced into the flow together with gas, depending on the well operation conditions. As chemical substances, used can be any known substances, usually used in oil production practice, for example, corrosion inhibitors, salt and wax accumulations, or emulsifying agents to render the gas-liquid flow stable. This practically eliminates expenditures to fight said accumulations, primarily enhancing the efficiency of oil production, whereas introduction of the known surfactants will ensure carrying out of heavily water-cut products to the wellhead.

When a reservoir has an abnormally low pressure and its power is not enough for an efficient transformation and lift of the gas-liquid flow (mixture) to the wellhead, specialists effect building-up of the bottom-hole pressure by way of, for example, well deepening or using the sump already provided (the distance from the reservoir (formation) to the well bottom), at the expense of an additional pressure of the formation fluid column in the given sump, and transformation of the formation fluid into a gas-liquid flow is effected below the depth of the formation occurrence; in this case a power gain is obtained owing to a difference in density of the formation fluid and that of the gas-liquid mixture over a section from the depth of formation occurrence to the depth (place) of transformation.

Example: a reservoir (formation) at a depth of 2,000 m has a pressure of 7.0 MPa, the formation fluid has a density of 800 kg/m$^3$ and a gas saturation of 300 m$^3$/m$^3$, the differential pressure being equal to 2 MPa under normal conditions.

Under given conditions the well cannot flow on its own, since at a bottom-hole pressure of 5.0 MPa, the maximum height of lift of the mixture with a desity of 400 kg/m$^3$ will be only 2,000 m which, with reference to hydraulic losses and wellhead pressure, will result in shut-in of the well.

When deepening the well to a depth of 4,000 m, the bottom-hole pressure will be $7.0-2.0+800\cdot(4{,}000-2{,}000)\cdot 10^4=21.0$ MPa; performing transformation of the formation fluid at this depth, we shall obtain a column of the gas-liquid flow (mixture) having a density of 400 kg/m$^3$, whereas the column pressure is 16.0 MPa, which is by 5.0 MPa less than the bottom hole pressure, i.e. the well will spout even at a drop of the formation pressure down to 4.0 MPa.

EXEMPLARY EMBODIMENT OF THE CLAIMED METHOD

In a well, the productive oil formation occurs at a depth of $H=3{,}000$ m and is saturated with oil having a density $\gamma_d=800$ kg/m$^3$, with gas saturation $G=250$ m$^3$/m$^3$, saturation pressure $P_{sat}=12.0$ MPa, formation pressure $P_f=18.0$ MPa, optimal depression $P=3.0$ MPa, the oil-gas mixture starting separation into oil and gas when the oil-to-gas ratio becomes equal to 1:10.

Under usual conditions of operation, noticeable degassing of oil will occur at lowering of pressure below 60 MPa, i.e. from a depth of approximately 1,500 m, to which an average density of the oil-gas mixture column will equal nearly 800 kg/m$^3$; from a depth of 1,500 m to a depth of nearly 500 m an average density of the oil-gas mixture column will equal nearly 400 kg/m$^3$, the pressure at this depth will be nearly 0.3 MPa; above this depth free gas will occur; at a wellhead pressure of 0.3 MPa the well will shut in.

When operating such a well according to the claimed method, forced liberation of the dissolved gas is effected in the well bottom, the weighted mean density of the oil-gas mixture from the well bottom to the wellhead will be 300 kg/m$^3$, the pressure of the whole column of the oil-gas mixture will be 9.0 MPa, the wellhead pressure for preventing separation of the mixture is set equal to 2.5 MPa, pressure losses for friction are less than 0.5 MPa, the pressure over the zone of transformation will equal 9.0+2.5+0.5=12.0 MPa, which is not higher than saturation pressure level, i.e. the well will flow normally on its own, since the bottom-hole pressure in this case will be 18.0−3.0=15.0 MPa.

If at a depth of 3,000 m over the zone of transformation it is impossible to develop a pressure less than the saturation pressure owing to an insufficient amount of gas or owing to a low saturation pressure, then this zone of transformation must be located at a lesser depth, at which this condition is fulfilled or it is necessary to move on to a method at which the prescribed amount of additional gas is fed into the oil-gas mixture in the relative rarefaction zone which is created in the well by this flow, as described above.

Figure 2:
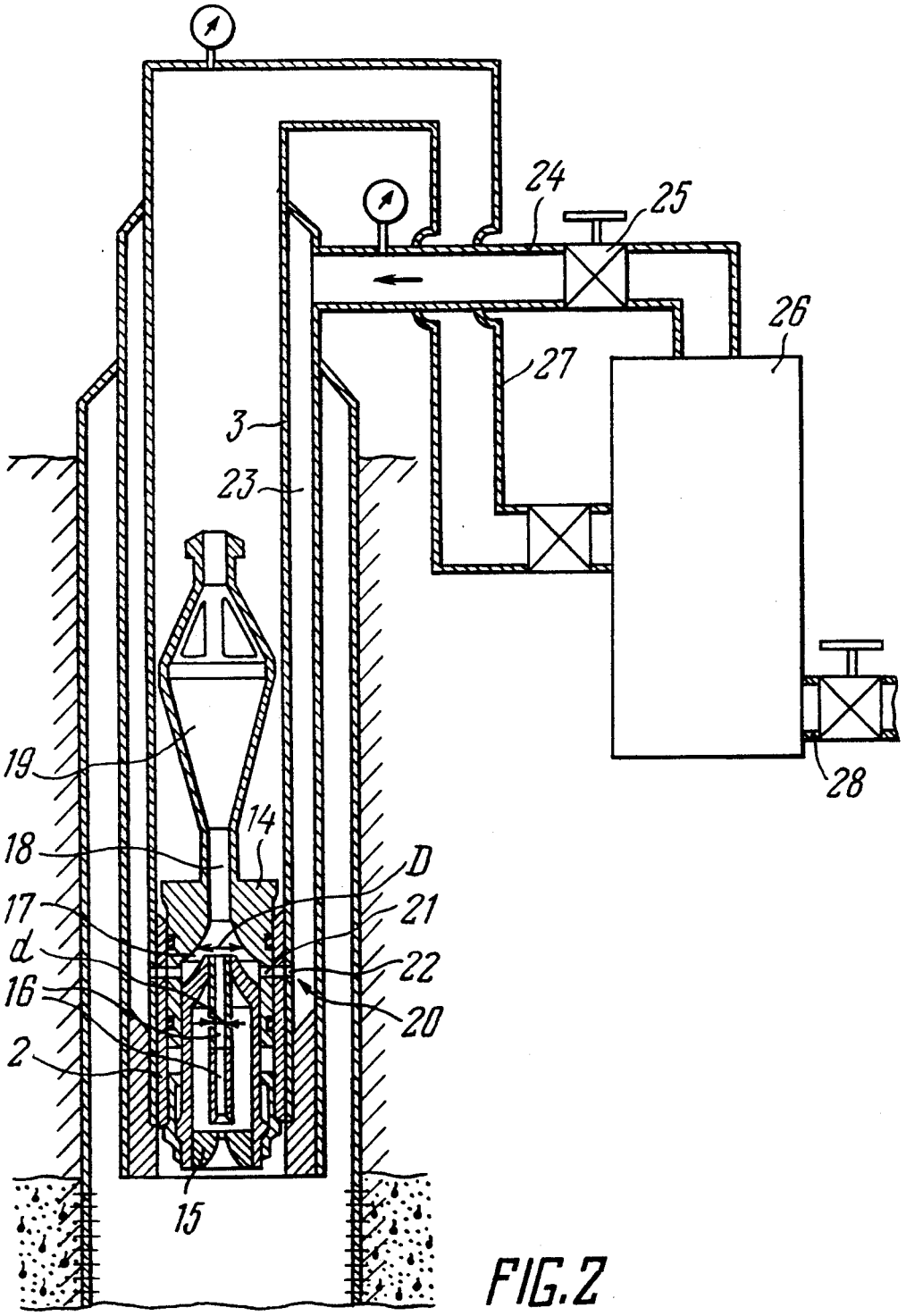
FIG. 2 is the same, which is illustrated in FIG. 1, but another embodiment.
Figure 3:
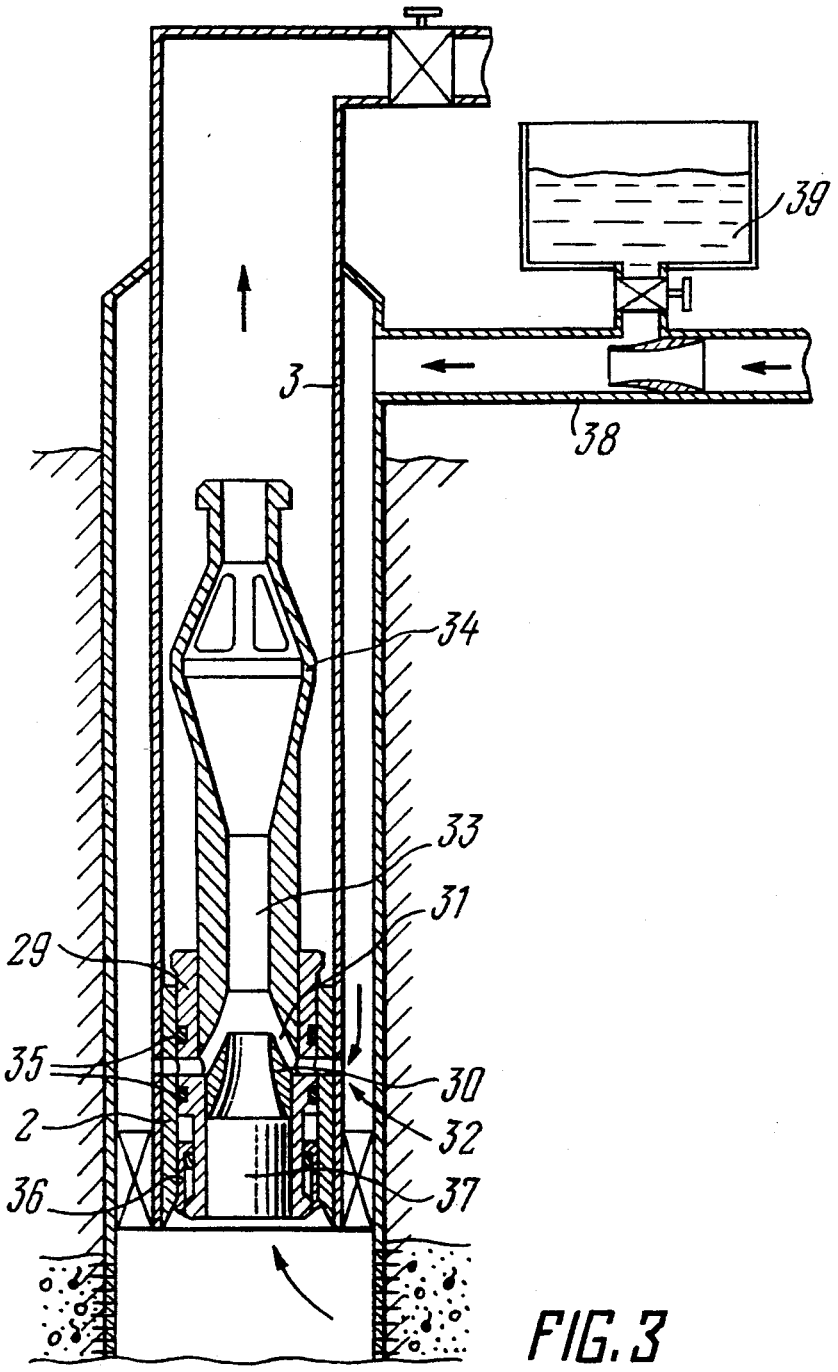
FIG. 3—still another embodiment of the device for the production of the formation fluid, longitudinal section.

The claimed method of producing the formation fluid, oil or gas condensate is realized by means of a device whose alternative embodiments are given in FIGS. 1-3. Each of this devices is installed in the well at the prescribed depth determined by the well and formation conditions, as well as by physical properties of the formation fluid, being designed for liberation of gas, dissolved in the formation fluid, by throttling the flow of this fluid, allowing specialists to most fully use the energy of gas dissolved therein.

The device presented in FIG. 1 comprises a body 1 hermetically secured in a seat 2 of a string 3 of the well at the prescribed depth, and a means 4 located in the body 1 for forced liberation of gas dissolved in the formation fluid and transformation of the formation fluid into a finely dispersed gas-liquid flow.

The means 4 is formed by a nozzle 5 and venturi flow devices such as Venturi tubes 6, forming a channel expanding stepwise towards the mouth. The nozzle 5 is installed in the body 1 along the well axis, being orientated with its outlet hole towards the mouth, and is intended to form a high-speed flow of the formation fluid.

The Venturi tubes 6 (or one tube 6) are installed over the nozzle 5 coaxially to it, ensuring, by way of developing a relative rarefaction, forced liberation of gas dissolved in the formation fluid and transformation of a high-speed stream, which leaves the nozzle 5, into a finely dispersed gas-liquid flow.

The number and diameter of the tubes 6 are determined by the amount of gas dissolved in the fluid and by a pressuure difference over and below the device, since each subsequent tube prevents the transfer of pressure into the previous tube which creates the necessary speed of the stream for the subsequent tube. Tubes 6 are installed one over the other so that each below-positioned tube serves as a nozzle for the above-positioned one. Mounted in the bottom part of the body 1 is a collet-type holder 7 intended for securing the body in the seat 2, sealing elements 8 being located above the seat 2, serving as a means for sealing the body in the seat 2 of the string. The upper part of the body 1 locates a fishing head 9 of the known design, wherein a fishing tool is secured, used for round trip operations.

It goes without saying that the wellhead is equipped with a controllable valve 10 whose regulating unit 11 serves to set a wellhead pressure that is registered by a pressure gauge 12, was well as with other equipment obvious for specialists who work in this field, ensuring automatic operation of the well.

The claimed device operates as follows.

Upon starting the well, owing to a pressure difference below and above the device, the flow of the formation fluid, passing through the nozzle 5, forms a high-speed stream, the potential energy of the flow being transformed into a kinetic one, the pressure in the stream, that escaped into the tube 6, drops and the gas dissolved in the formation fluid id liberated, owing to rarefaction, into a free phase in the form of small bubbles, and the formation fluid is transformed into a finely dispersed gas-liquid flow which, owing to the expansion of its volume, comes up, as it were, and rushes to the wellhead.

The effect is repeated in each subsequent tube, which results in a fuller liberation of gas dissolved in the formation fluid. In this case, owing to a considerable lowering of the weighted mean density of the gas-liquid flow column in the well tubes, the bottom-hole pressure is transferred to the controllable valve which, when the prescribed pressure is attained, gets open and, on the contrary, gets closed when the pressure drops; this prevents a sharp increase of the gas saturation factor in excess of the figure ten and facilitates a more efficient evacuation of the formation fluid to the wellhead.

In compliance with the alternative embodiment shown in FIG. 2, the device, in addition to the body 14, nozzle 15 and Venturi tubes 16 made and located similarly to the elements of the same name of the device shown in FIG. 1, additionally comprises a receiving chamber 17, mixing chamber 18, diffuser 19 and a means 20 for a sealed communication of the receiving chamber 17 with the wellhead.

The receiving chamber 17 is arranged in the body 14 above the Venturi tube 16 coaxially to it, and is made with a diameter D which exceeds a diameter d of the upper Venturi tube 16 (that is, sufficient for a free interaction of the stream with gas), which ensures a free supply of an additional amount of gas into the mixing chamber 18 owing to relative rarefaction developed by the gas-liquid high-speed stream, escaping from the nozzle 15.

The mixing chamber 18 is coaxially located over the receiving chamber 17, being communicated with its upper part. The diffuser 19 is installed on the body 14 over the mixing chamber 18 being in communication with it. A fishing head is arranged on the upper part of the diffuser 19 for securing a fishing tool in round trip operations.

The means 20 for a sealed communication of the receiving chamber 17 with the wellhead is formed by radial holes 21 and 22 arranged coaxially and made, respectively, in the body 14 and the string, and by the hermetically sealed hole annular clearance 23 (or by a pipeline not shown in figure), communicated through holes 21 and 22 with the receiving chamber 17, which fact ensures the supply to this chamber of an additional amount of gas from the wellhead, owing to a difference between the wellhead pressure and the pressure of relative rarefaction in the chamber 17. The hole annular clearance 23 through a pipeline 24, equipped with a controllable valve 25, is communicated with a separator 26 of the known design. The separator 26 is equipped with a pipeline 27 which communicates it with a string intended to supply gas-liquid flow of the formation fluid into the separator 26, and with a pipeline 28 for removing from the separator 26 of the leading product after separation of the formation fluid flow into liquid and gaseous phases.

Operation of such a device is effected essentially similarly to that of the above-described device given in FIG. 1; in this case, in the process of outflow of the finely dispersed gas-liquid stream from the pipe 16 into the receiving chamber 17, a relative rarefaction is created by this stream in the latter chamber 17, which rarefaction, through the receiving chamber 17, radial holes 21 and 22, hole clearance 23 and pipeline 24, is transferred into the separator 26, wherein a pressure is formed by the wellhead pressure of the gas-liquid flow supplied to the separator 26 through the pipeline 27. Owing to a difference of these pressures, effected is a supply of an additional amount of gas from the separator 26 into the receiving chamber 17 which, together with the gas-liquid flow gets into the mixing chamber 18 where their interaction and mixing occur.

The diffuser 19 serves to effect a smooth rise of pressure (over its length) which is necessary to prevent the transfer of high pressure into the mixing chamber 18 and to prevent possible cavitation.

Thus, the mixing chamber is supplied from the nozzle 15 with not a simple liquid formation fluid, but with a finely dispersed gas-liquid flow whose volume considerably exceeds the initial volume of the liquid, which ensures self-lift of the fluid to the wellhead.

The alternative embodiment of the device made according to FIG. 3 also comprises, as the above-described devices, a body 29, hermetically secured in the string, which houses a nozzle 30, receiving chamber 31 which is located over the nozzle 30 coaxially with the latter, a means 32, which is similar to the means 20 (FIG. 2), hermetically communicating the receiving chamber 31 (FIG. 3) with the wellhead for the supply into this receiving chamber an additional amount of gas owing to a difference between the gas wellhead pressure and the pressure in the rarefaction zone of the receiving chamber 31, a mixing chamber 33 with a diameter that essentially equals the diameter of the outlet hole of the nozzle 30, installed coaxially over the receiving chamber 31, a diffuser 34 installed over the mixing chamber 33 and communicated with the latter, as well as means 35 and 36 for sealing and securing, respectively, the body 29 in the string.

As distinct from the above-described devices, this device comprises a hydraulic pulser 37 of the known design, installed in the body 29 under the nozzle 30 and transforming the laminar flow of the formation fluid into a pulsating one.

Operation of such a device is effected as follows.

After starting the well, under the action of a difference in pressures under and over the device, the flow of the formation fluid gets into the hydraulic pulser 37 which transforms the laminar flow into a discrete pulsating one which is subsequently transformed by the nozzle 30 into a pulsating high-speed flow which creates a relative rarefaction in the receiving chamber 31, further on the process is realized similarly to that described in the above-mentioned method with receiving chamber 31, mixing chamber 33 and diffuser 34 combining together to form a venturi flow device.

A distinction consists in that the pulsating stream realizes a process of creating the relative rarefaction and mixing of flows that fundamentally differs from the above-described one. This process consists of two phases: an active phase during which delivery of a portion (pulse) of the stream is effected, and a passive phase during which a rarefaction zone occurs, following the accelerated portion of the stream, in which zone supplied is an additional amount of gas, owing to a pressure difference. Then the cycle is repeated. In this case a possibility appears to control the ejection factor by regulating the duration of the active phase and the whole cycle. Thus, setting the relation of the cycle duration to the active phase that equals 10, we shall obtain the ejection factor which equals 9, which is noticeably higher than the ejection factor created by other devices. The duration of each cycle is selected, proceeding from the production rate, pressure difference and the length of the mixing chamber so that it would contain two portions (pulses) of the stream at any moment.

When necessary, for example, for stabilization of foam of heavily water-cut oil, a preassigned metered amount of surfactants from a reservoir 39 is supplied in the gas flow through the pipeline 38 owing to, for example, ejection; said surfactants efficiently bind the oil-gas mixture and prevent its separation which facilitates lowering of the bottom-hole pressure owing to full evacuation of the product. If it is necessary to fight asphalt-resin-wax accumulations, use is made of appropriate inhibitors which are supplied simultaneously with an additional amount of gas into the gas-liquid flow, as described above.

So, employment of the claimed method of production of the formation fluid and the device for effecting thereof results in raising the efficiency of production and development of oil deposits at the expense of rejection to employ expensive power and metal consuming mechanized methods of oil production, lowering of oil production costs, increasing the time of stable operation of the well, and considerable cut-down in expenditures to fight wax and salt accumulations.

We claim:

1. A method of production of formation fluid from a well having a bottom-hole and a wellhead, and with the well being in communication with formation fluid having a saturation pressure, comprising:

creating a flow of the formation fluid in the well, said step of creating a flow of the formation fluid including forcedly liberating gas dissolved in the formation fluid so as to transform, at a location within the well, the formation fluid into a finely dispersed gas-liquid flow such that there is formed in the well, from the location of transformation to the wellhead, a fluid column of finely dispersed gas-liquid flow with the liberated gas forming part of said gas-liquid flow and such that the total of the pressure of said fluid column and the wellhead pressure is lower than the saturation pressure of the formation fluid with dissolved gas and lower than the difference between the pressure of the formation fluid at the bottom-hole and the pressure of a formation fluid column extending from a depth of occurrence of the formation to the location of said transformation.

2. A method according to claim 1, in which the pressure of the gas-liquid flow at the wellhead is set not lower than a critical pressure of separation of the gas-liquid flow into independent phases.

3. A method according to claim 1, in which the pressure of the formation fluid at the bottom hole is set and maintained higher than the pressure of saturation of the formation fluid with dissolved gas.

4. A method according to claim 1 further comprising the step of forming a rarefaction zone in the well through which the gas-liquid flow passes, and the step of forming the rarefaction zone including supplying from the wellhead an additional amount of gas to the rarefaction zone so as to further saturate the gas-liquid flow with an additional amount of gas, with the quantity of additional amount of gas being based on the difference between the pressure of the separated gas at the wellhead and the pressure of the rarefaction zone and the degree of saturation of the formation fluid with dissolved gas.

5. A method according to claim 4, further comprising introducing into the gas-liquid flow, simultaneously with saturating the gas-liquid flow with an additional amount of gas, a prescribed amount of chemical substances.

6. A method as recited in claim 1 wherein said step of forcedly liberating gas dissolved in the formation fluid includes passing the formation fluid through a nozzle converging in a downstream direction and then through a plurality of coaxially aligned venturi tubes.

7. A method according to claim 1, in which the location of transformation of the formation fluid is located at a depth exceeding that of the formation occurrence.

8. A method according to claim 1, further comprising the step of forming a zone of relative rarefaction in the well by saturating the gas-liquid flow with an additional amount of gas.

9. A method according to claim 8 wherein the step of saturating the gas-liquid flow with an additional amount of gas includes separating gas at the wellhead from the gas-liquid flow and directing the separated gas into the zone of relative rarefaction.

10. A method according to claim 9 wherein the separated gas is drawn from the wellhead of the rarefaction zone due to a suction effect created by the flow of the gas-liquid flow through the rarefaction zone as well as a pressure differential between the pressure of the separated gas at the wellhead and the pressure of the gas in the rarefaction zone

11. A method as recited in claim 1 wherein said step of forcedly liberating gas dissolved in the formation fluid includes passing said formation fluid first through a nozzle converging in a downstream direction and then through a venturi flow device.

12. A device for the production of formation fluid through a well string, comprising:

a body;

means for securing said body in the string;

means for sealing said body in the string;

a nozzle installed in said body which is dimensioned and arranged so as to speed up the flow of formation fluid travelling therethrough;

a venturi flow device positioned above and coaxially with said nozzle so as to receive the formation fluid exiting said nozzle, said venturi flow device being dimensioned and arranged for forced liberation of gas dissolved in the formation fluid and transformation of the fluid into a finely dispersed gas-liquid flow.

13. A device as recited in claim 12 wherein said venturi flow device includes a venturi tube.

14. A device as recited in claim 13 wherein said body includes a receiving chamber positioned above said venturi tube, said receiving chamber having a passageway therethrough which converges in an upstream to downstream direction and which is coaxial with said venturi tube, and said body further including a mixing chamber downstream from said receiving chamber and having an upstream diameter equal to a downstream diameter of the passageway in said receiving chamber, and said mixing chamber being in fluid communication with a diffuser positioned downstream from said mixing chamber.

15. A device as recited in claim 14 further comprising a fluid communication line opening at one end into said receiving chamber and having a second end in communication with a gas supply source.

16. A device as recited in claim 14 further comprising a separator in fluid communication with the gas-liquid flow exiting said body, said separator including means for separating gas from the gas-liquid flow exiting said venturi flow device; and a fluid communication line extending from said separator to said receiving chamber so as to form a rarefaction zone wherein, due to the flow of the gas-liquid flow through the rarefaction zone and a difference between the pressure of the separated gas at the separator and the pressure of the rarefaction zone, the separated gas further saturates the gas-liquid flow with separated gas.

17. A device as recited in claim 16 further comprising a reservoir and means for feeding chemicals from said reservoir to separated gas passing through said fluid communication line.

18. A device as recited in claim 12 further comprising a plurality of venturi tubes positioned one above the other in coaxial, stacked fashion.

19. A device as recited in claim 18 wherein there are at least three venturi tubes.

20. A device as recited in claim 12 wherein said venturi flow device has a receiving chamber formed therein which converges in an upstream to downstream direction, said venturi flow device further having a mixing chamber formed therein which at one end, opens into said receiving chamber, said mixing chamber having a cross-sectional area which is less than the upstream end of the receiving chamber, and said venturi-shaped device also comprising a diffuser, said mixing passageway opening at a downstream end into said diffuser.

21. A device as recited in claim 20 further comprising a hydraulic pulser installed in said body for transforming a laminal flow of the formation fluid into a pulsating flow, and said hydraulic pulser being positioned below said nozzle.

22. A device as recited in claim 20 further comprising a separator in fluid communication with the gas-liquid flow exiting said venturi flow device, said separator including means for separating gas from the gas-liquid flow exiting said venturi flow device; and a fluid communication line extending from said separator to said receiving chamber so as to form a rarefaction zone, and wherein, due to the flow of the gas-liquid between the pressure of the separated gas and a difference between the pressure of the separated gas and the pressure of the rarefaction zone, the separated gas further saturates the gas-liquid flow with separated gas.

23. A device as recited in claim 22 further comprising a reservoir and means for feeding chemicals from said reservoir to said fluid communication line.

* * * * *